US008038030B2

(12) United States Patent
Peters et al.

(10) Patent No.: US 8,038,030 B2
(45) **Date of Patent: *Oct. 18, 2011**

(54) FLOOR CLEANING MACHINE

(75) Inventors: Marco Peters, Trittau (DE); Heinrich Katenhusen, Bad Oldesloe (DE)

(73) Assignee: Hako-Werke GmbH, Bad Oldesloe (DE)

( * ) Notice: Subject to any disclaimer, the term of this patent is extended or adjusted under 35 U.S.C. 154(b) by 347 days.

This patent is subject to a terminal disclaimer.

(21) Appl. No.: 12/236,703

(22) Filed: Sep. 24, 2008

(65) Prior Publication Data

US 2009/0045208 A1 Feb. 19, 2009

Related U.S. Application Data

(63) Continuation of application No. 10/854,459, filed on May 26, 2004, now Pat. No. 7,555,801.

(51) Int. Cl.
*B65D 25/10* (2006.01)
*B65D 53/00* (2006.01)
*B65D 81/24* (2006.01)

(52) U.S. Cl. ..... 220/761; 15/83

(58) Field of Classification Search ..... 220/62.18, 220/627, 675, 760, 761, 763, 775, 776, 908; 15/83, 264

See application file for complete search history.

(56) References Cited

U.S. PATENT DOCUMENTS

| | | | | |
|---|---|---|---|---|
| 1,399,634 | A | 12/1921 | Lund | |
| 5,090,587 | A * | 2/1992 | Brown | 220/475 |
| 5,194,077 | A | 3/1993 | Bargiel et al. | |
| 5,224,617 | A * | 7/1993 | Gaudreault | 220/266 |
| 5,690,247 | A * | 11/1997 | Boover | 220/495.11 |
| 6,494,341 | B2 * | 12/2002 | Perkins et al. | 220/764 |
| 7,555,801 | B2 * | 7/2009 | Peters et al. | 15/83 |

* cited by examiner

*Primary Examiner* — Harry Grosso
(74) *Attorney, Agent, or Firm* — Wildman, Harrold, Alle & Dixon LLP

(57) ABSTRACT

A floor-cleaning machine which can be driven over the floor, includes a driven brush for sweeping the floor to be cleaned. The brush picks up dirt and debris from the floor and carries it, assisted by forced air flow, in an overhead motion and through a transfer duct to a pair of dirt containers in the form of buckets located side-by-side at the rear of the machine. A manual linkage at the rear of the machine moves a pivoted carrier frame which holds the dirt containers, between a raised use position in which the upper rims of the dirt containers are sealed to the machine for collection of debris, and a lowered access position for removal of the containers. Each container is independently accessible for emptying, and includes a bail-type handle pivotally attached such that a bucket, the opening of which faces forwardly and upwardly in the use position, extends generally horizontal when removed, to avoid spillage. Each container has a recess adjacent the inlet opening for receiving the handle in the operating position.

8 Claims, 4 Drawing Sheets

FLOOR CLEANING MACHINE

RELATED APPLICATIONS

This is a continuation application claiming the priority of U.S. application Ser. No. 10/854,459 filed on May 26, 2004, which claims the priority of Application No. 103 24 826.9 filed May 30, 2003 in Germany.

FIELD OF THE INVENTION

The present invention relates to floor cleaning machines; and more particularly to powered sweepers having a forward cylindrical brush which delivers dirt and debris, in cooperation with a forced air stream, to a collection hopper or container in the rear of the machine.

BACKGROUND OF THE INVENTION

Floor sweepers are known which have bucket-type dirt pick-up containers. Some machines have containers of integral construction, others have two separate dirt containers. The larger, single containers may extend transversely substantially over the entire width of the machine, in which case they are bulky and heavy. In order to remove the dirt accumulated within the single container, the operator must remove it manually, carry the container and contents to a disposal area, and empty it by turning it over. Typically, the operator may shake the container to remove finer particles. Because of the weight and size of such single hoppers, discarding collected debris may be difficult.

If the standard single hopper is too heavy for a particular application, or if the customer so desires, two separate smaller containers may be purchased in place of the single larger hopper. Nevertheless, the dirt containers rest on a flat, continuous bottom frame, and, where two containers are used, each dirt container can be handled in the same way as a bucket. The containers are positioned on a solid bottom or pan adjacent one another, and located as closely as possible to each other such that as much of the dirt as possible which is delivered by the brush and air stream will be collected. The handles of the dirt containers are pivoted on the inner sides of the dirt containers and, in the use or collection position, the handles lie within the inlet opening of the dirt container so that the handles are subject to the same dirt as the interior of the containers.

Despite the close side-by-side arrangement of the dirt containers on the frame, it is inevitable that a portion of the dirt delivered by the machine will not reach the dirt containers and will fall between or around the dirt containers. The outer surfaces of the dirt containers thus become dirty. Furthermore, dirt accumulates on the carrying handles during use. For that reason, the operator, in the process of emptying the containers, may soil his hands and his clothing due to the accumulation of dirt on the outer surfaces and handle of the dirt containers. The accumulation of dust on the solid bottom surface of the container frame interferes with locating the containers accurately in the use position, requiring the operator to separately clean the bottom surface of the dirt container frame at regular intervals.

SUMMARY OF THE INVENTION

A primary object of the present invention is to configure a floor-cleaning machine such that the handling of collected dirt in dual, separate containers is more convenient for the operator, and avoids direct operator contact with the dirt during removal, transportation and emptying of the containers. Yet, more of the dirt recovered by the machine is placed in the dirt containers.

According to the present invention, a floor-cleaning machine of the type described includes dual collection containers mounted side-by-side on a pivoting carrier frame which can be moved conveniently by a lever between a raised cleaning or use position and a lowered access position. The upper edge surrounding the inlet opening of each dirt container in the cleaning position engages and seals with the edge of a dirt delivery opening in a casing wall of the machine. The handles of the containers are in the form of bails, having straight legs pivotally mounted on the outer side of the containers. The handles are stored in recesses formed in the upper perimeters containers adjacent inlet openings of the containers, but exterior to sealing edges of the containers and within the confines of a double-wall construction.

Thus, the dirt is delivered through a closed conduit system comprising a dirt transfer duct directly to the interior of the dirt containers, directed by inclined routing surfaces into the dirt containers and without contacting the handles or the outside surfaces of the dirt containers. Moreover, the dirt does not accumulate beneath the container on the supporting frame because the carrier frame supports the dirt containers only about the perimeters of the container bottoms, and has open center areas beneath the containers to prevent dirt accumulation. Thus, the dirt which enters through the dirt delivery openings (Which are framed with material the strength of which corresponds to that of the casing of the machine) wilt be completely delivered to the dirt containers without traveling laterally around the dirt containers and thus accumulating on the frame and/or on the outer surfaces of the dirt containers. Furthermore, the handles of the dirt containers that are located outside of the aperture area of the corresponding dirt container remain clean; and the operator can advantageously, in the manner of a bucket, handle the dirt containers either in the filled or in the emptied state, without the risk of getting his hands soiled on the handles.

In this connection, it should be mentioned that towering the container carrier frame to the access position also lowers the rear edge of the dirt containers, thus providing access to the interior of the containers from the rear of the floor-cleaning machine. This allows the operator to empty the contents of a dustpan or to place other items, such as foil wrappings or packing tapes, directly into the dirt container. It is desirable that these and other items not be picked up by the cleaning brush.

The construction of the present invention also enables the utilization of plastic bags as seating disposal containers. The bags can be inserted, with the dirt containers removed or in place, and with the carrier frame in the lowered position, into the dirt containers. The upper portion of the inlet of the bag may be folded over the edge of the container, further protecting the handles and sealed to the upper edge containers when the carrier frame is raised to the use position. The utilization of such plastic trash bags enables the operator to close the bags by hand in the familiar manner, followed by the removal of the filled bag from the dirt container, thus enabling dirt to be removed in a sealed bag without generating dust or spillage.

In order to seal the dirt containers in the cleaning position, when the carrier frame is raised, the entire upper edge of the containers engage and seal against a flexible sealing member placed about the dirt delivery opening in the casing wall above each container. This arrangement has the advantage that the seal is located in a largely protected area, whereas, if it were arranged at the aperture edge of the container, there would be a risk of damage to the seal when the container is removed or otherwise handled.

The pivoting carrier frame preferably includes positioning aids for providing open-bottom receptacles for the containers and for locating and positioning the containers, and assuring proper alignment of the dirt delivery apertures with the container inlet openings. The carrier frame includes a positioning bar having a ridge extending transverse to the longitudinal direction of the floor-cleaning machine, which is received in a mating groove at the rear of the container bottoms. This positioning bar supports, aligns and positions the containers in the desired use position on the carrier frame. Furthermore, the dirt containers are secured by upright bars or plates to prevent any lateral movement on the carrier frame.

The dirt containers of the present invention preferably have a generally triangular shape when viewed from the side. That is, when placed in the cleaning position, the back wall is vertical, the bottom wall is horizontal and the inlet or delivery aperture is inclined at an angle of approximately 30°-40° relative to the horizontal to approximate an angle of repose for small particles such as dust or fine sand. This reduces the height of the front portion of the container to facilitate insertion and removal of the container, while permitting the container to fill more completely during use while using most of the available space in the container for storage of dirt. The bail handle is connected to the container at a position above the center of gravity of a uniformly filled container so that the container rotates upon removal with the inlet opening becoming generally horizontal. In this way, a full hopper will not spill the contents when carrying the container in bucket fashion for emptying.

In order for the dirt containers to be located closely adjacent to each other on the carrier frame, at least one upper portion of the peripheral area of the rear wall of the dirt container may be displaced inwards (i.e. recessed) to provide a finger recess in relation to the adjacent peripheral wall of the dirt container. This upper finger recess permits an operator to grab a container and remove it from the carrier frame in the access position.

The handle recess extends from the pivot points of the handle, around the sides and rear edge of the dirt container so that in the access position, the container and handle are accessible. The recessed area for the handle (as well as the upper finger recess) insures that the handle does not project laterally outwardly of the container, but rather is in general alignment with the exterior walls of the container. The handle storage recess, coupled with the fact that the containers have a double wall construction, permits the containers to be placed in the carrier frame with their adjacent exterior walls very close to one another to reduce the possibility of dirt failing between the containers while in the machine.

Furthermore, this arrangement includes a dirt guide extending above adjacent side walls of the containers with inclined lateral surfaces to direct dirt into the inlet openings of containers to protect the small space between containers from collecting dirt.

Furthermore, in the lower area of the rear wall of each container or in the adjacent bottom area) a lower, second finger recessed grip or handle is provided. This lower recessed handle facilitates tipping during emptying the dirt container that is held by the bail or carrying handle in the other hand.

Other features and advantages of the present invention will be apparent to persons skilled in the art from the following detailed description of the illustrated embodiment, in which identical reference numerals will refer to like parts in the various views.

DETAILED DESCRIPTION OF THE ILLUSTRATED EMBODIMENT

Figure 1:
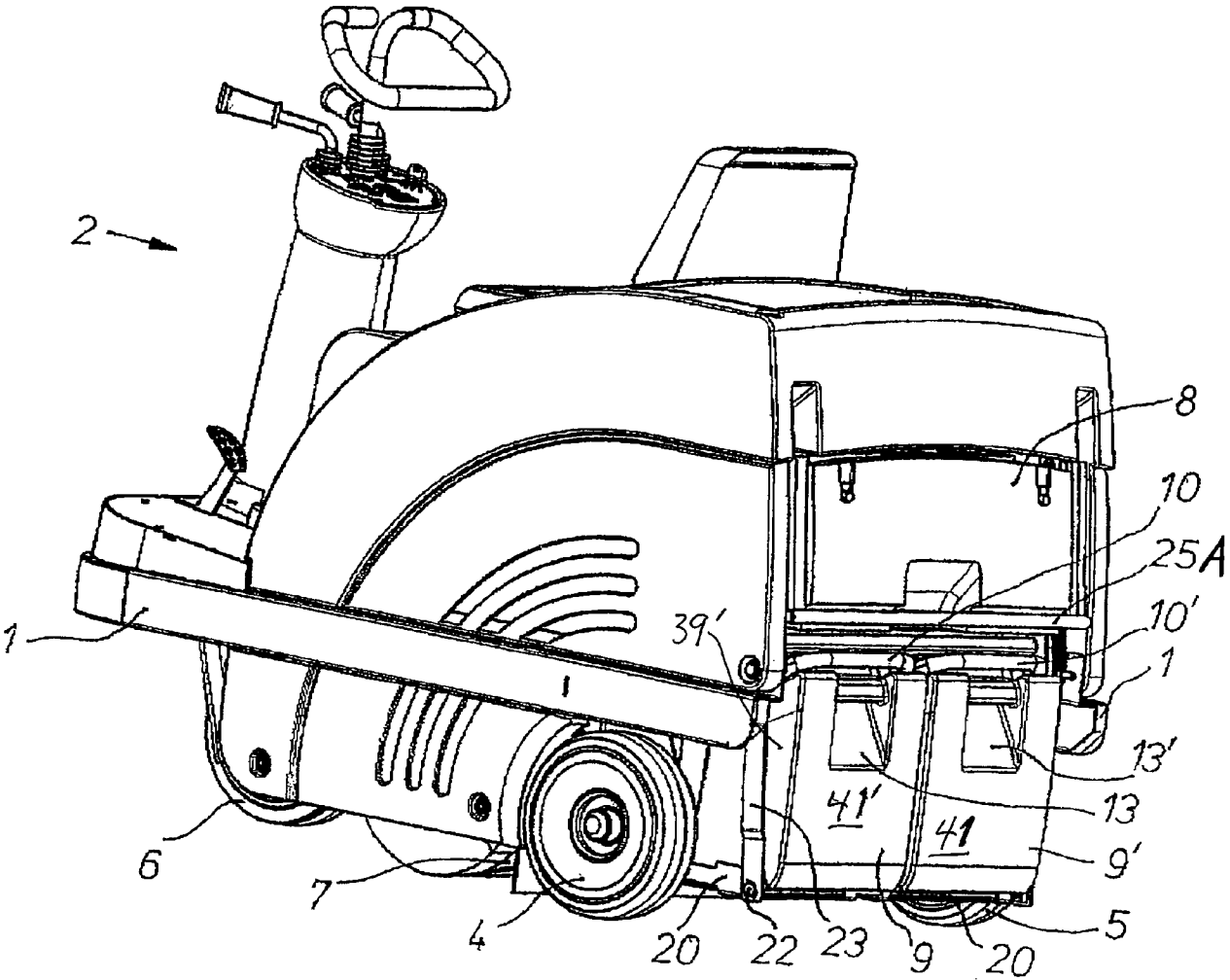
FIG. 1 is a perspective view of a floor cleaning machine incorporating the present invention taken from a left side and rear view.

A floor-cleaning machine illustrated in FIG. 1. The machine 2 is of a known type of construction and has a chassis 1 or main frame, on which there are mounted rear wheels 4 and 5 and a front wheel 6. The front wheel 6 is driven and steerable by the operator. On the chassis, there is a forward operators station 2 which includes a driver's seat and the controls necessary for operation of the floor-cleaning machine. The floor-cleaning machine has a rotary-driven roller or cylindrical brush 7, which, in operation, contacts the floor to be cleaned, and picks up dust, dirt and other debris in an overhead motion.

The dirt is transported by the brush 7 and an air stream generated by an impeller (not shown) which creates suction to the rear of the brush. The dirt is carried via a dirt transfer duct 12A through dirt delivery openings in a wall of the outer casing, and thence into inlet openings of dirt containers 9, 9', to be described. The air stream with entrained dirt and dust travels along the dirt transfer duct 12A. Heavier materials fall under gravity into the containers and the air and lighter materials pass through a conventional filter located above the container inlet openings for filtering the solids. The clean, filtered air then exits into the atmosphere.

This overall construction and mode of operation of a floor-cleaning machine are generally known and require no additional explanation to persons skilled in the art.

Figure 2:
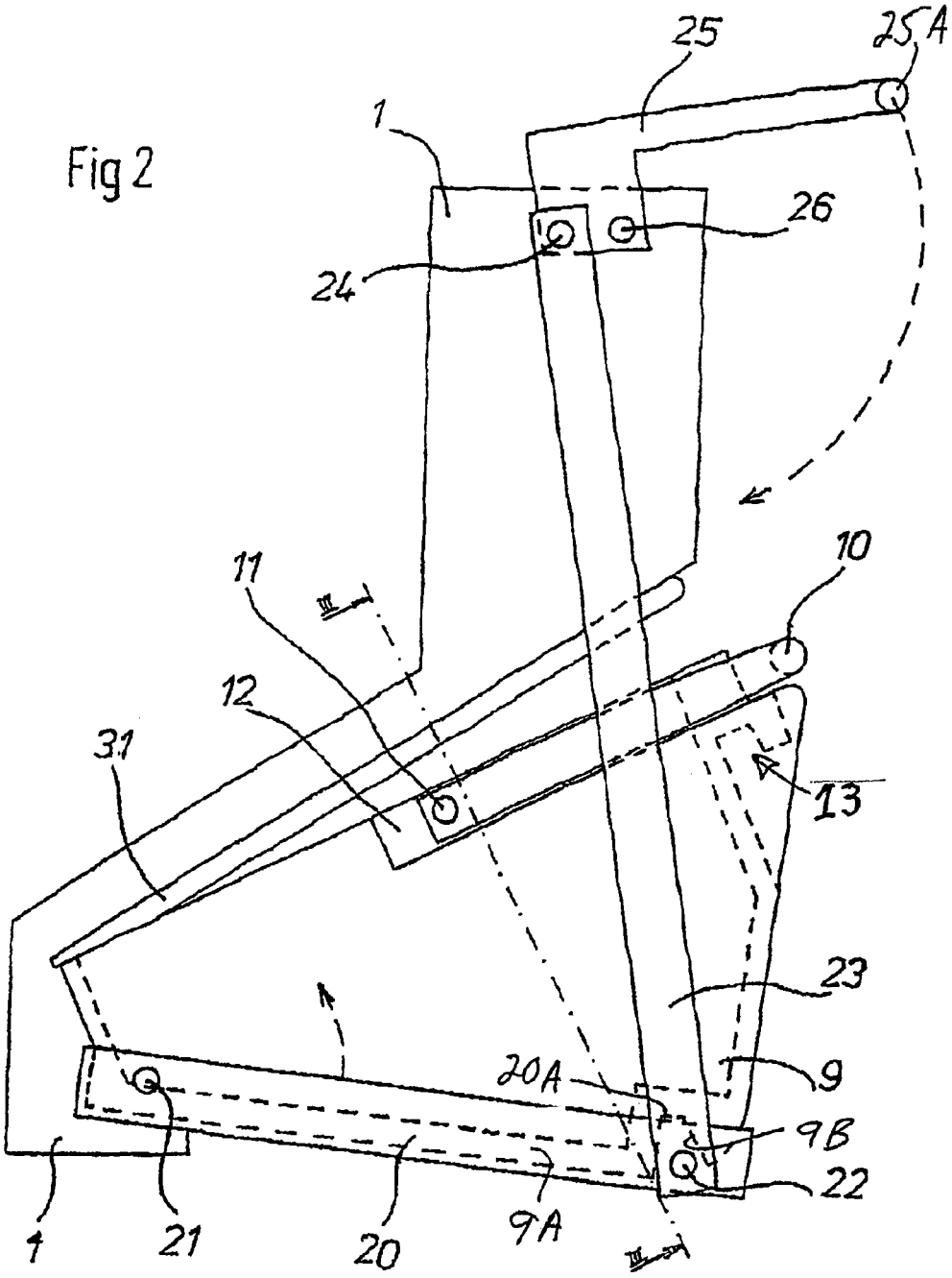
FIG. 2 is a partial, diagrammatic view, taken from the left side, of a portion of the machine of FIG. 1 illustrating the carrier frame and actuating linkage for moving the carrier frame and dirt containers between the raised use position and the lowered access position with the dirt containers in the lowered or access position.
Figure 3:
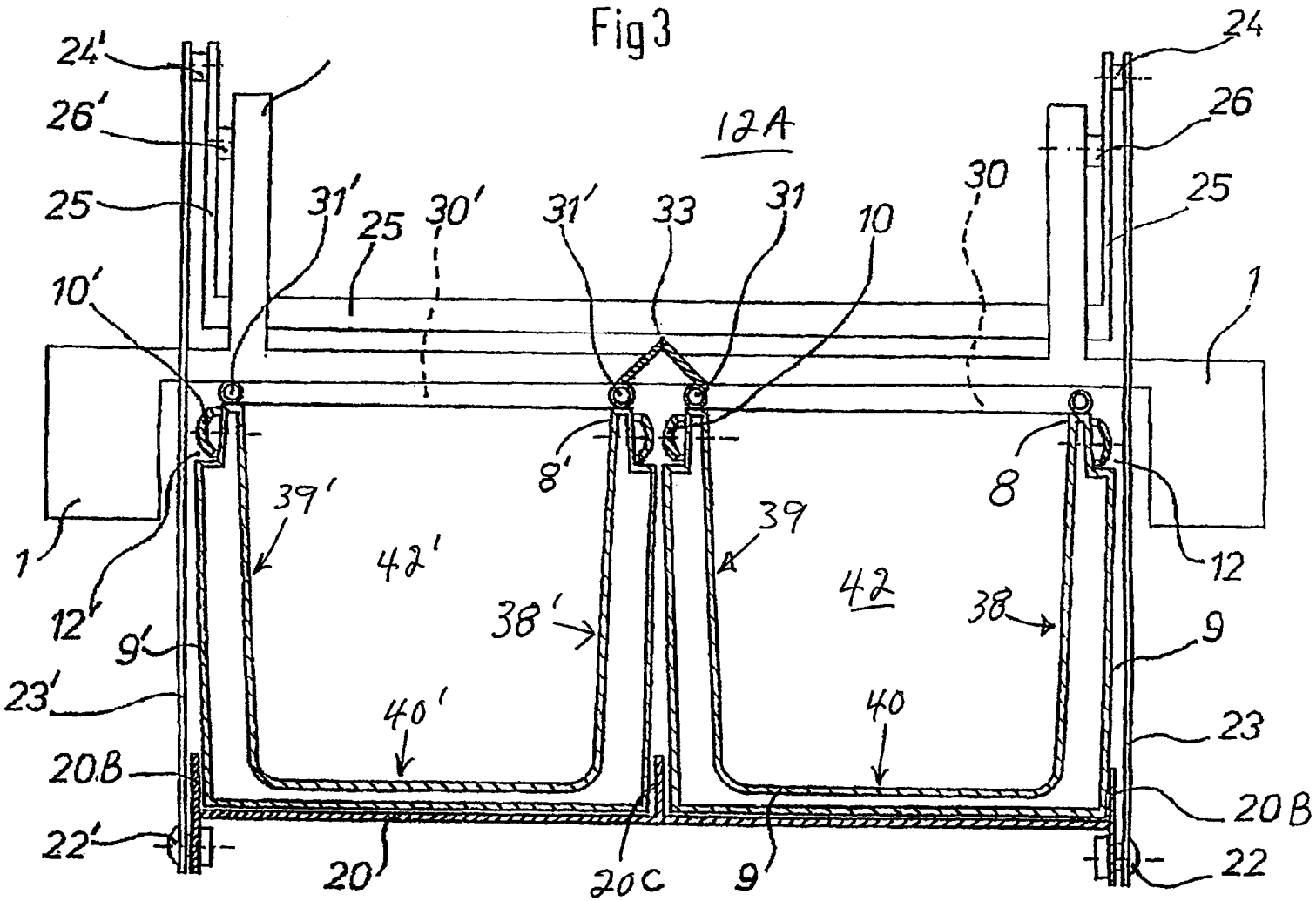
FIG. 3 is a vertical transverse section view taken through the section line 3-3 of FIG. 2 showing the arrangement of dirt containers in the use position.

Turning now to FIGS. 2 and 3, the rear section of the floor-cleaning machine 2 corresponds to FIG. 1 in a simplified or schematic form. The outer housing or casing and the filter are not shown for simplicity.

As already mentioned, the dirt that is picked up from the floor by cylindrical brush 7 is carried to a did transfer duct 112A in communication with dirt delivery openings 30, 30' (indicated in FIG. 3) formed in a rear wall of the casing, and hence strong. The dirt then drops through container inlet openings 8,8' for carrying and transporting recovered materials to first and second dirt containers 9, 9'. Dust and lighter materials are carried along by the air stream and removed from the air stream by a conventional filter system (located above the dirt delivery openings 30, 30') before the air is returned to the atmosphere, as is conventional.

As used herein, the terms "left" and "right" refer to the left and right side of an operator facing the forward direction of the machine (that is, to the left in FIG. 1). Moreover, "longitudinal" refers to the fore-to-aft direction of the machine, that is, the direction of movement of the machine, and "transverse" refers to the lateral or side-to-side direction.

Figure 2A:
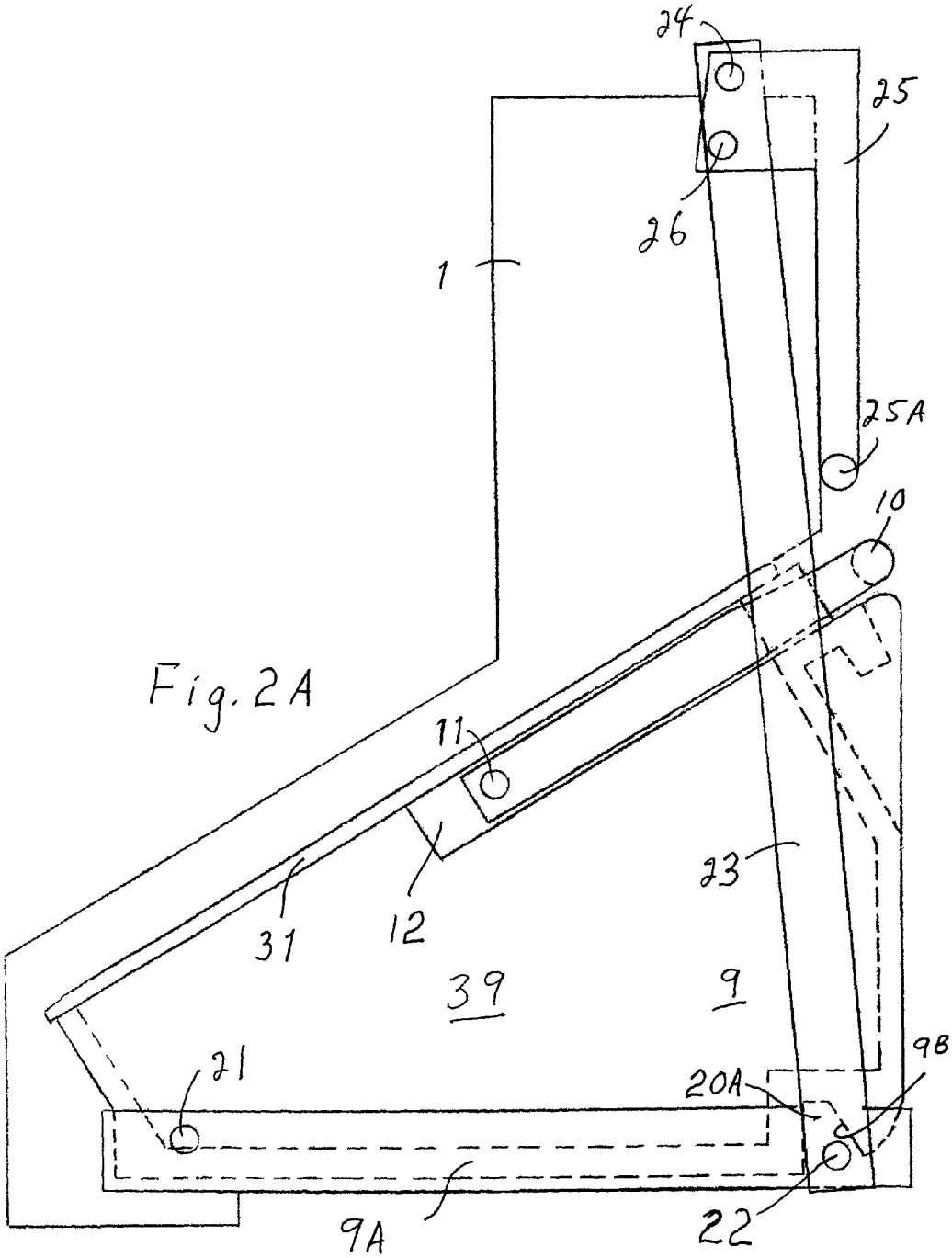
FIG. 2A is a view similar to FIG. 2 with the carrier frame and dirt containers in the raised or use position.

Dirt containers 9, 9' are aligned side-by-side in the transverse direction. The containers 9, 9' are supported by a carrier frame 20 which is configured such that the dirt containers are reliably supported and positioned by their outer walls and the peripheral area of the bottom of the containers; and the center area of the carrier frame, located beneath the containers, is open. In this context, the positioning of dirt containers 9, 9' is achieved in the longitudinal direction of the floor-cleaning machine by transverse recesses (such as that designated 9B for container 9') formed in the rear of the bottom wall 9A of the dirt container 9', as illustrated in FIG. 2. The recess 9B is received on a ridged cross bar 20A of carrier frame 20. Thus—in the upright position of the dirt containers, the containers 9, 9' are positioned and secured to the floor-cleaning machine when the carrier frame is raised to the use or sealed position seen in FIG. 2A. In the transverse direction, dirt containers 9, 9' are positioned by vertical guides or flanges 20B on the sides and 20C in the center that are part of, and extend above the carrier frame 20 (see FIG. 3) and provide seats to secure the containers in place laterally.

The dirt containers are located for access at the rear of the machine, but could be located at the front as well. Each dirt container includes first and second side walls 38, 38' and 39, 39', a bottom 40, 40', an upright exterior wall 41, 41' (which is a rear wall in the illustrated embodiment) and an inner wall 42, 42' (which is a forward wall in the illustrated embodiment).

An operating lever 25 includes a transverse handle (see 25A in FIG. 1), which, when actuated, operates both left and right side connecting rods 23. In the position seen in FIG. 2, the right side operating lever 25 is seen in the lowered or container access position. The left side operating linkage is similar to the right side. Sealing rings or gaskets 31 are secured to the bottom of the casing wall in which the dirt delivery openings are formed, and the seals encompass completely these openings. Thus, when the carrier frame 20 is lowered to the access position (FIG. 2), the rear of the containers is spaced from sealing ring 31 secured to the casing about the periphery of the dirt delivery opening 30' for the container 9'. This provides access for the operator to place additional materials directly into the containers from the rear of the machine, as by a dust pan or by hand (for example, foil wrappers, tape or string) which are undesirable materials for pick-up by the brush. Carrier frame 20 is pivoted at its front to the main frame by pivot pin 21 for pivoting about a transverse horizontal axis. In the outer area of carrier frame 20, connecting rods 23, 23' are pivotally connected at lower ends by pivot pins 22, 22'. The upper ends of connecting rods 23, 23' are pivotally connected by pins 24, 24' to an operating lever 25 which is pivotally mounted to the chassis 1 by left and right pins, one of which is seen at 26. A corresponding lever is mounted on the left side. By virtue of engagement of the operating lever and pivoting through a neutral position, the Operator can thus conveniently and easily maneuver the carrier frame 20 between the raised operating position illustrated in FIGS. 1, 2A and 3, and the lowered, or access position illustrated in FIG. 2, and vice versa.

When the operator pushes the cross bar handle 25A downwardly (see arrow in FIG. 2) to rotate the operating lever 25 (and a corresponding lever and linkage on the left side) in a clockwise direction as illustrated by the arrow in FIG. 2, rotating about pivot 26, the connecting rods 23 are raised, thereby lifting the carrier frame 20 and causing the upper rims of the containers to engage their associated seals 31, 31'. Moreover, from FIG. 2A, it will be observed that the axis of pivot 24 moves over-center relative to a line drawn between the axes of pivots 22, 26, thereby locking the carrier frame and containers in the raised position for operation, with the transverse handle 25A engaging and housed in the rear section of the outer casing of the machine for safety and stability (FIG. 1).

Dirt containers 9, 9' are of similar construction, and therefore only dirt pick-up container 9 need be described for a complete understanding of the Invention.

Dirt container 9 is a double-walled construction having inner and outer walls, and is preferably manufactured by a conventional rotational molding process. In its outer bottom wall 9A, the above-mentioned transverse rear recess 98 forms a receptacle for ridged cross bar 20A of the carrier frame 20. Referring to FIG. 3, at the outer periphery of the upper container inlet opening (designated 8 for container 9) of each dirt container, on its outer side and rear, there is a peripheral recess arranged to receive a handle 10 pivotally mounted to the container by connecting pin 11. The pivoting connection of the handle 10 locates the pivot axis above the center of gravity of dirt container 9 when filled with the same material such that it can be supported by handle 10, in the manner of a bucket. That is, when a container is removed and held by its handle, the container opening rotates such that the inlet opening 8, which is inclined upwardly and rearwardly in the use position (FIG. 2A) is generally horizontal for transport to avoid spilling.

The outer portion of the upper peripheral area is recessed to receive the handle 10 such that the handle, when folded, is within this recessed area 12 and hence within an upper extension of the adjacent outward surface of the dirt container, i.e. it does not protrude above the top edge nor laterally beyond the side of the outer wall of the double-wall container, as seen in FIG. 3. The extension of the recess 12 forwardly past connecting pivot pins 11 provides for unobstructed pivoting of the U-shaped handle 10. In other words, when viewed from the top, the recess 12 also has a U-shape to conform: to the shape of the bail handle 10 which has left and right straight legs, the distal ends of which are pivotally connected to the bucket within the recess (see 11 in FIG. 2).

In the upper area of the outer rear (or exterior) wall of dirt container 9, beneath the handle recess, there is a central upper recessed handle or finger grip 13. By gripping this recess, the operator can readily remove or insert the dirt container when the carrier frame is lowered to the access position. The locating recess 9B located in the bottom wall of dirt container 9 may be used as a second finger recess for pivoting the container being held in the other hand by handle 10 for emptying the contents.

As can be seen in FIG. 2, the inlet aperture of the dirt container 9 forms a plane which is inclined in the use position extending from a forward position, upwardly and rearwardly at an included angle of approximately 35° with the horizontal, and preferably in the range of 30°-40° This angle may approximate an angle of repose for light, smaller particulate material such as fine sand, to permit the containers to be filled without spilling over in the use position.

As can be seen from FIG. 3, between the two inlet apertures 30, 30', there is an enclosed area of the dirt transfer duct. In order for this to remain free of dust, there is a peaked or ridged dirt guide surface 33 of generally inverted V-shape, the peak of which extends along the adjacent sides of the container so that any dirt that may also have been deposited in this area will be directed or routed laterally into dirt containers 9, 9'.

As will now be understood, dirt containers 9, 9' can readily be inserted into the carrier frame 20 in the lower access position, in accordance with FIG. 2, and the containers can then be removed. For this purpose, at the rear end, an access gap is provided above the container through which the operator can place any dirt picked up with a dustpan, or other items, into the dirt containers.

If the carrier frame 20 is raised by pivoting the operating lever 25 from the lowered access position to the raised cleaning position, then the peripheral upper edges of dirt containers 9, 9' assume a sealed engagement with the elastic seals 31, 31' respectively, which are on the casing and encompass the dirt delivery openings 30, 30'. Dirt being delivered to the containers is confined, and placed directly into the dirt containers, whilst neither the outside handles 10, 10' nor the area between dirt pick-up containers 9, 9', nor the outer surfaces of the containers, will normally be contacted by dirt. Consequently, the dirt container to be taken out for emptying can be handled by the operator by the handle, in the manner of a bucket, and then emptied without the user having to be concerned about being soiled from gripping the handle and/or by contact with the outside of the dirt container. Furthermore, in operation, no dirt coming through inlet apertures 30, 30' will be deposited on carrier frame 20 which has open centers beneath the containers so that it need not be cleaned periodically, as required by some prior machines.

Having thus disclosed an illustrated embodiment of the invention, persons skilled in the art will be able to modify certain of the structure which has been shown and to substitute equivalent elements for those disclosed while continuing to practice the principle of the invention. For example, in the illustrated embodiment, the dirt containers are located at the rear of the machine, and are accessible from the rear. However, the containers could be located at the front of the machine so that the larger wall of each container is an exterior wall and the smaller will is an interior wall, for example. Moreover, the brush is designed for overhead dirt delivery, and could be a "dust pan" or underhand delivery of dirt, to the forward end, for example. It is, therefore, intended that all such modifications and substitutions be covered as they are embraced within the spirit and scope of the appended claims.

We claim:

1. A container for use in a mobile floor sweeper machine, comprising:

left and right upright side walls, an upright rear wall, a forward wall, and a bottom, said forward wall being shorter than said outer rear wall, said forward wall, rear wall and first and second side walls cooperating to define an inlet opening extending along a plane at an angle approximately in the range of 30°-40° relative to said bottom, each of said side walls, rear wall, forward wall being of a dual wall construction and cooperating to define a continuous, flat upper sealing edge adapted to seal with the casing of said machine when said container is in a use position relative to said machine, the upper edges of said left and right side walls and said rear wall defining a generally U-shaped outer first recessed portion constructed to receive a handle;

and a bail handle having extending legs, the distal portions of said legs of said handle being pivotally mounted to upper intermediate portions of said left and right side walls respectively and arranged to be housed within said first recessed portion such that extensions of the outer surfaces of said left and right side walls are outside the lateral portions of said handle when said handle is folded into said first recessed portion, and the upper surfaces of said left and right side walls and said rear wall define a sealing plane above said handle when said handle is received in said first recessed portion.

2. The container of claim 1 wherein the outer bottom wall of said container defines a transverse recess extending adjacent the rear wall thereof for receiving a ridged frame member.

3. The container of claim 2 wherein the pivot connections of said handle are located substantially above the center of gravity of said bucket when said container is filled with dirt such that the inlet opening of said container rotates to a generally horizontal position for carrying when said container is removed from a machine.

4. The container of claim 1 wherein said rear wall includes a second recessed portion on an outer surface thereof, and wherein said second recessed portion is adapted for manual grasping to facilitate removal of the container from and insertion of the container into the mobile floor sweeper machine.

5. The container of claim 4 wherein said second recessed portion is disposed on an upper portion of the outer surface of said rear wall.

6. The container of claim 4 wherein an outer portion of said bottom disposed adjacent said rear wall includes a third recessed portion adapted to receive a ridged frame when in the use position in the mobile floor sweeper machine for ensuring proper positioning of said container in the mobile floor sweeper machine, and wherein said third recessed portion is further adapted for manual grasping to facilitate emptying of said container.

7. The container of claim 1 wherein an outer portion of said bottom includes a recessed portion disposed adjacent said rear wall, wherein said recessed portion is adapted to receive a ridged frame member when in the use position in the mobile floor sweeper machine for ensuring proper positioning of said container in the mobile floor sweeper machine.

8. The container of claim 7 wherein said recessed portion is further adapted for manual grasping to facilitate emptying of said container.

* * * * *